United States Patent [19]

Behrend et al.

[11] 4,435,118

[45] Mar. 6, 1984

[54] METHOD OF CONTROLLING HORIZONTAL MOTION OF A LOAD APPLICATION POINT ON AN ARTICULATED CRANE

[75] Inventors: Volkmar Behrend, Bad Schwartau; Eckhard Röder, Lübeck, both of Fed. Rep. of Germany

[73] Assignee: O & K Orenstein & Koppel Aktiengesellschaft, Fed. Rep. of Germany

[21] Appl. No.: 482,001

[22] Filed: Apr. 5, 1983

[30] Foreign Application Priority Data

Apr. 6, 1982 [DE] Fed. Rep. of Germany ..... 3213332

[51] Int. Cl.[3] ..... B66C 23/00; B66C 23/52

[52] U.S. Cl. ..... 414/744 R; 414/786; 414/4; 414/140; 212/190; 212/223; 212/270; 212/247

[58] Field of Search ..... 212/190, 159, 192, 223, 212/245-247, 251, 270; 414/137-140, 1, 591, 744 R, 744 A, 786, 4

[56] References Cited

U.S. PATENT DOCUMENTS

| | | | |
|---|---|---|---|
| 2,420,867 | 5/1947 | Crosby | 414/744 B |
| 3,240,360 | 3/1966 | Richards | 414/744 A |
| 3,828,943 | 8/1974 | Simon | 414/744 A |
| 3,845,289 | 10/1974 | Taguchi et al. | 414/744 A |
| 3,963,135 | 6/1976 | Coeurderoy | 414/744 A |
| 4,303,368 | 12/1981 | Dent et al. | 414/590 |
| 4,311,031 | 1/1982 | Schwerze | 414/744 A |
| 4,352,627 | 10/1982 | Schneider et al. | 414/627 |
| 4,392,776 | 7/1983 | Shum | 414/744 R |

FOREIGN PATENT DOCUMENTS

| | | | |
|---|---|---|---|
| 1414354 | 11/1975 | United Kingdom | 212/190 |

*Primary Examiner*—Trygve M. Blix
*Assistant Examiner*—R. B. Johnson
*Attorney, Agent, or Firm*—McGlew and Tuttle

[57] ABSTRACT

A method and apparatus for controlling the horizontal motion of a double articulated crane comprises determining the angle about a common axis between a base member pivotally mounted on a crane post and a head member carrying a load application point on an outer end thereof. The angle can vary from 0° to 360°. A desired movement direction value is then set on a direction selector movable on a direction indicator. The value corresponds to a target position for the load application point. The desired movement direction value is adjusted by small increments to reach the target however. The desired movement direction value is broken up into two components, one aligned with the axis of the head and the other aligned with a perpendicular axis. The values of these two compartments are calculated as a function of the sin or cos of an angle of misalignment between the longitudinal axis and the direction of the selector. The pivotal speed of the base member about the crane post and the head member about the common axis between the base and the head members is then calculated and utilized to drive the equipment for rotating the members.

15 Claims, 5 Drawing Figures

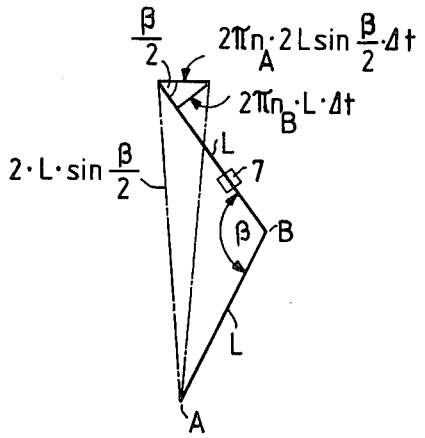
FIG.4
FIG.5
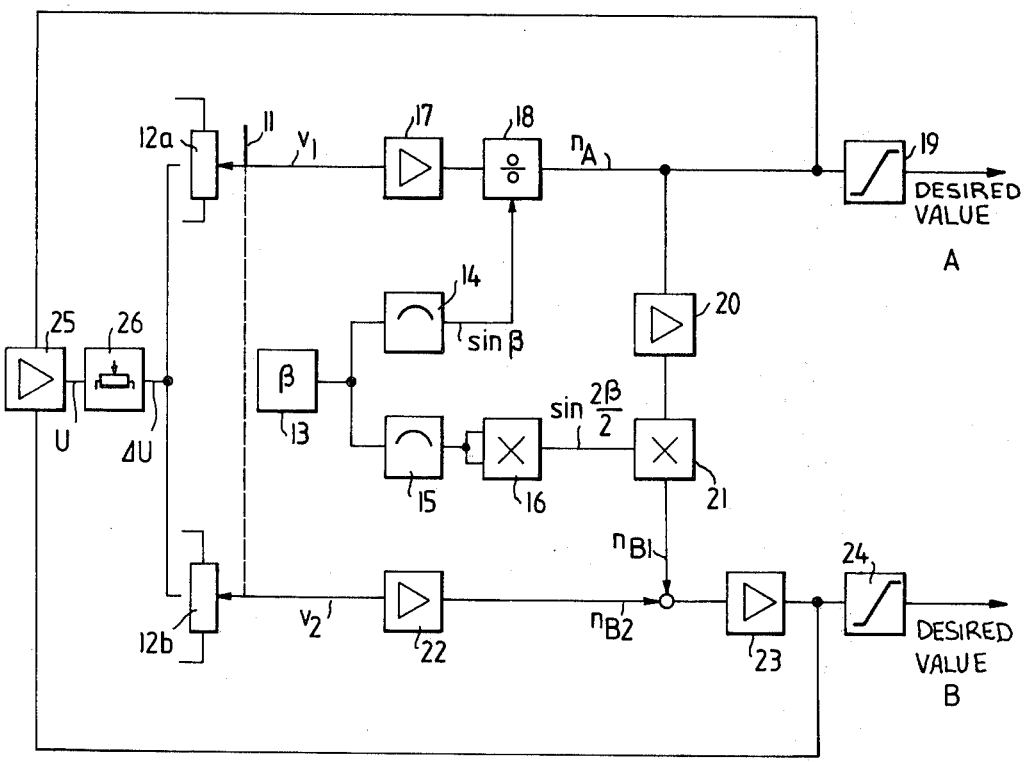

METHOD OF CONTROLLING HORIZONTAL MOTION OF A LOAD APPLICATION POINT ON AN ARTICULATED CRANE

FIELD AND BACKGROUND OF THE INVENTION

The present invention relates in general to ship cranes and in particular to a new and useful method and apparatus of controlling the horizontal motion of a double articulated crane.

The steadily increasing volume of container cargo shipping makes a further devleopment of shipboard handling systems imperative to reduce turnaround times in ports and simplify the handling of goods. Experience with conventional shipboard crane constructions have led to a development of new loading systems. What was sought were primarily optimum vision conditions for the crane operator, a faster and more accurate control of load movements, and smaller overall heights of the cranes, to improve the vision from the bridge.

A new kind of shipboard crane has been developed in this direction, namely so called articulated cranes having their boom comprised of a base section or member, and a head member. The base member is pivotable as an arm on the crane post, and the base and head members cooperate in the manner of an elbow joint.

A prior art control for the drives of handling equipment, particularly a ship crane, provides a loading tackle at the end of a hinged boom, and controlled drives for at least one sluing, hoisting and/or traveling gear. The drives are equipped with controllers having their desired value inputs connected to transmitters of a model-loader, by which the desired sequential movements are picked up and transmitted as desired values to the control, and the end of the model boom is guided by means of a guide body in a base plate, with the guide body being operatively connected to a drive. The speed of the drive is adjustable by a setting member having a setting handle. The path of motion of the base joint of the model boom is adjustable in order to adapt to varying distances (German OS No. 28 06 399).

Such a control has the disadvantage of being very expensive. A special model is required, for example. Further, the pickup or unloading points can be reached only in a straight-line approach, i.e. sequentially by following coordinates of the target point.

SUMMARY OF THE INVENTION

The present invention is directed to a control of the sluing gear between the base member and the crane post, and of the other sluing gear provided between the base member and the head member. The electrical control is to be inexpensive and to make it possible to approach the pickup and unloading points directly.

Accordingly, an object of the present invention is to provide a method and apparatus of controlling horizontal motion of the load application point on an articulated crane having a base member, a head member of substantially equal length L as a base member, the base member being connected at one of its ends to a crane post through a sluing gear for rotation on an axis A and at another end thereof to one end of the head member through another sluing gear rotating on a common axis of rotation B of the base and head members, the head member carrying the load application point on another end thereof, comprising determining the angle $\beta$ formed between the base member and a longitudinal axis of the head member, presetting a desired moving direction value v for the load application point by means of a drive direction selector of a drive direction indicator provided on the head member, readjusting the desired moving direction value by small increments, forming from the desired moving direction value, a head axis component value $v_1$ which equals v cos $\alpha$ and a perpendicular axis component value $v_2$ which equals v sin $\alpha$, with $\alpha$ being an angle of misalignment between longitudinal axis of the head member and the drive direction selector, and determining the pivotal speed $n_A$ of the base member about the axis of rotation A on the crane post in accordance with the equation $n_A = v_1/2L\pi \sin \beta$ and the pivotal speed $n_B$ of the head member about the common axis of rotation B in accordance with the equation $n_B = -2n_A \sin^2 \beta/2 \pm v_2/2\pi L$.

Note that the plus or minus sign of the equation for determining the pivotal speed about the common axis signifies differences introduced by the specific quadrant in which the selector finds itself since the head member can pivot about the common axis B from 0° to 360°.

The speeds are determined by control voltages, with $n_A$ corresponding to the pivotal speed of the base member about the crane post, and $n_B$ corresponding to the pivotal speed of the head member about the common axis of rotation B of the base and head members. These are then multiplied with a constant making allowance for the transmission ratio and for data from the electrically driven sluing gear. Speeds $n_A$ and $n_B$ have mutually opposite directions.

A further object of the invention is to provide a device for achieving the control method which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the following, one embodiment of the invention is schematically illustrated in the accompanying drawings in which:

FIG. 4 is a diagram showing geometric relationships; and

FIG. 5 is a block diagram showing an example of an electrical arrangement for carrying out the inventive method.

DESCRIPTION OF THE PREFERRED EMBODIMENT

Figure 1:
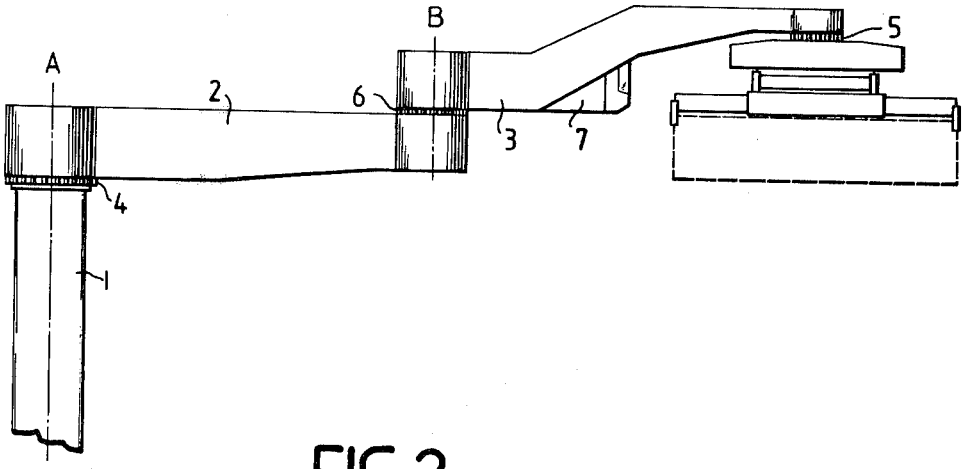
FIGS. 1 and 2 are a side elevation and a top plan view, respectively, of an articulated crane boom.

Identical elements are designated with like reference numerals in the figures, which show, in FIG. 1 a crane post 1 connected to a base member 2 through a sluing gear 4. Base member 2 is pivotable about an axis of rotation A. At its other end, base member 2 cooperates through another sluing gear 6 with a head member 3, with the axis of rotation B of gear 6 being common to both members. Head member 3 carries on operator's cabin 7 wherefrom the movements of the load application point 5 are controlled. In the top plan view of FIG. 2, the angle $\beta$ is indicated which is formed between base member 2 and head member 3. This angle may assume any value between 0° and 360°, except for two limits dicated by a load at point 5 and it is measured between the longitudinal axis 9 of head member 3 and the corresponding axis of base member 2.

Figure 2:
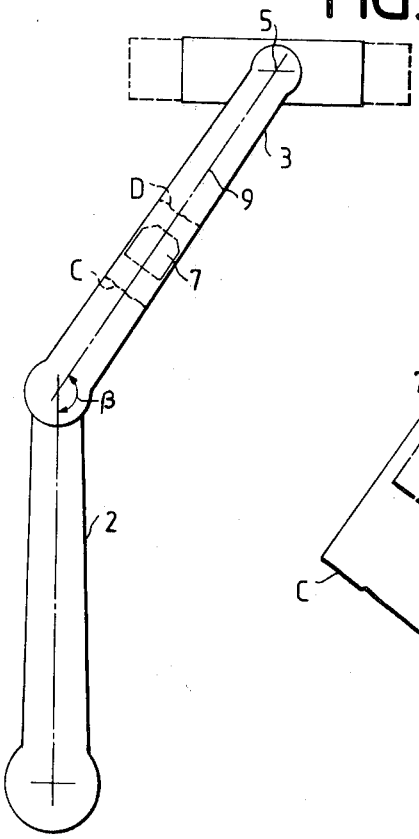
Figure 3:
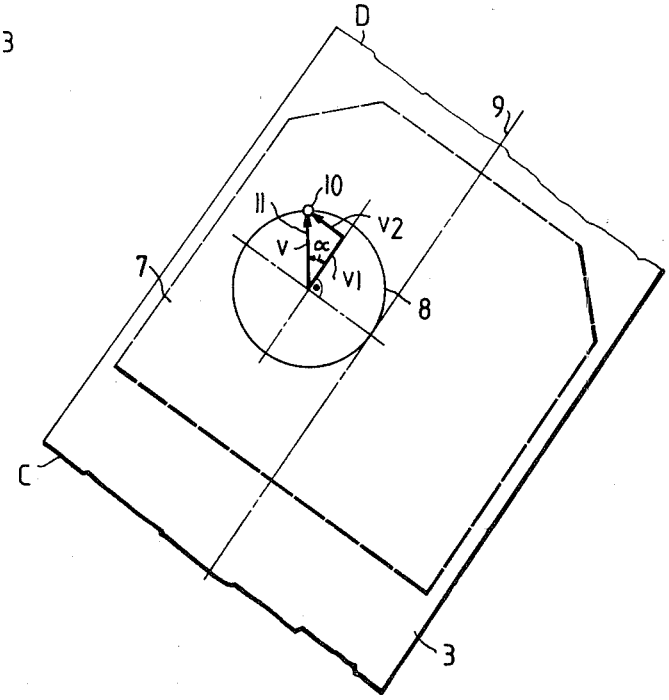
FIG. 3 is a detail of a portion of the head member, indicating an operator's cabin and a drive direction sensor provided therein.

FIG. 3 illustrates a detail between brake line CD of FIG. 2. A drive direction sensor 8 and a drive direction selector 11 are shown which are both accommodated in the operator's cabin 7. To start the control, the end point 10 of selector 11 is brought into alignment with the target point, i.e. the location to be reached by the load application point, and in the course of further control, this end point is then continually adjusted toward the target, because of the motion of head member 3. End point 10 thus moves along a circle on drive direction sensor or indicator 8. The line connecting the center of sensor or indicator 8 with end point 10 of the selector at the same time represents a vectorial desired value v of the direction of motion. An angle $\alpha$ is formed between vector v and the longitudinal axis 9 of head member 3. A resolution of vector v leads to a component having the value $v_1 = v \cos \alpha$ in the axial direction 9, and a component having the value $v_2 - v \sin \alpha$, in the direction perpendicular thereto. Sensor 8 thus can be in the form of a circular track on which the outer end 10 of selector 11 may ride. Selector 11 may be a sighting rail which is rotatably mounted at the inner end to the center of the circular track. The operator uses aims rail 11 to the target for load point 5.

FIG. 4 explains the geometric relations. In the representation, which is approximately an isosceles triangle, the sides L,L proportional to the substantially equal lengths of the base and head members 2,3 form an angle $\beta$ therebetween. The axes of rotation of the two boom members 2,3 are indicated at A and B. The small square 7 on one of legs L indicates the operator's cabin. Starting from the third, non-designated vertex of the triangle, the assumed, or hypothetical, relationships are shown which occur after having pivoted head member 3 to the right by a very small amount. The side opposite pivot axis B of the triangle substantially maintains its length of $2L \sin \beta/2$.

For the small right-angled triangle shown at the top of the figure, and including the starting and end points of the small pivotal motion, it will be found that the hypotenuse is equal to $2\pi n_A \cdot 2L \sin \beta/2 \Delta t$, and the side perpendicular to the adjacent L is equal to $2\pi n_b L \Delta t$. The angle opposite this side in the small triangle equal $\beta/2$.

In the above terms, the following symbols are used:

L for the length of the member in meters;

$n_A$ for the pivotal speed at the point A, in rpm; and $n_B$ for the pivotal speed at the point B, in rpm.

While utilizing signals of the value $v_1$ and $v_2$ and taking into account that these signals effect mutually opposite rotations of the sluing gears, and after some arrangement the pivotal speed at A may be written as $$n_A = \frac{v_1}{4\pi L \sin \frac{\beta}{2} \cos \frac{\beta}{2}} = \frac{v_1}{2L\pi \sin\beta},$$

and the speed at B as $$n_b = \frac{v_1}{2\pi L} tg \frac{\beta}{2} \pm \frac{v_1 \sin_\alpha}{2L\pi} = \frac{v_1}{2\pi L} tg \frac{\beta}{2} \pm \frac{v_2}{2\pi L}.$$

To simplify the electrical representation of the above quantities, the pivotal speed at B may also be written $$n_B = -2n_A \sin^2 \frac{\beta}{2} \pm \frac{v_2}{2\pi L}.$$

FIG. 5 is a diagram showing an example of an electrical circuit for carrying out the inventive method. Drive direction sensor 8 comprises two potentiometers **12*a*, 12*b* which are provided in a common plane and offset by 90°, and of which one extends in the direction of the longitudinal direction or axis 9 of the head member, and both furnish output voltages which are a function of the position of drive direction selector 11. To this end, the slide of each potentiometer may be engaged with end 10 of selector 11. Potentiometer 12*a* forms the value $v_1$ and potentiometer 12*b* the value $v_2$. By means of an angle sensor 13 of any known type, angle $\beta$ between base member 2 and head member 3 is measured and converted into a voltage. A function generator 14 forms sin $\beta$ and another function generator 15 forms sin $\beta/2$. This last value is squared in a multiplier 16. In a summing amplifier 17, value $v_1$ is multiplied by the constant $1/2\pi L$. In a divider 18, sin $\beta$ is divided by this result. The value $n_A$ thereby formed is delivered to a desired value integrator 19 associated with the sluing gear between the crane post and the base member, and also to a reversing amplifier 20**. This amplifier has an amplification factor of $-2$.

In a multiplier 21, the values of $-2n_A$ and $\sin^2 \beta/2$ are multiplied with each other to obtain a value $n_{B1}$. In a summing amplifier 22, the value $v_2$ is multiplied with the constant $1/2\pi L$ to a value $n_{B2}$, and $n_{B1}$ is added to $n_{B2}$ in an adder 23, since $n_B = n_{B1} \pm n_{B2}$. This value is delivered to a desired value integrator 24 associated with the sluing gear between the base member 2 and the head member 3. Since the two desired values for speeds $n_A$ and $n_B$ are at the same time delivered to a control amplifier 25, the effect is produced that in case one of the desired values would reach its limit value, the preset value of the speed, which depends on the desired value v of the drive direction or the potentiometer voltage U, is reduced, so that all the further computations can be effected as provided. Since all the functions are valid only for minute increments of motion, the drive direction selector 11 must be recurrently adjusted into the target direction by the operator.

The sluing gears are not driven in jerks, their speed is increased continuously from the start, as symbolically represented in the respective blocks of desired value integrators 19,24. The limitation of speeds $n_A$, $n_B$ is also symbolically indicated. These limits are given by the supply voltage U of the two potentiometers **12*a*, 12*b***.

Now, superimposed on the just described control circuit operating with a preset limit of speed is a speed control permitting the increase of the pivotal speed and a variation of this increase. This control is embodied by a voltage setting element 26 which, upon being actuated, increases the supply voltage U by an amount $\Delta U$. This, however, may also be done by means of a potentiometer, in cooperation with another mechanical control element, such as a treadle.

An on-off switch (not shown) may be provided for controlling the mechanism at the load application point. The switch would be associated with drive direction sensor 8, particularly in combination with selector 11.

Point 10, as a practical matter, can be a handle which is held by the operator and slowly rotated forward toward the final target postion for the load.

The reference numerals and the parts they designate are here listed:

1 crane post
2 base member
3 head member
4 sluing gear
5 load application point
6 sluing gear
7 operator's cabin
8 drive direction sensor
9 head member axis
10 end point of drive direction selector
11 drive direction selector
12*a* potentiometer
12*b* potentiometer
13 angle sensor
14 function generator
15 funtion generator
16 multiplier
17 summing amplifier
18 divider
19 desired value integrator
20 reverse amplifier
21 multiplier
22 summing amplifier
23 adder
24 desired value integrator
25 control amplifier
26 voltage setting element
A axis of rotation
B common axis of rotation
v desired value of drive direction While a specific embodiment of the invention has been shown and described in detail to illustrate the application of the invention, it will be understood that the invention may be embodied otherwise without departing from such principles.

What is claimed is:

1. A method of controlling horizontal motion of a load application point on an articulated crane having a base member, a head member of substantially equal length L as the base member, the base member being connected at one of its ends to a crane post through a sluing gear for rotation on an axis A and at another end thereof to one end of the head member through another sluing gear rotating on a common axis of rotation B of the base and head members, the head member carrying the load application point on another end thereof, comprising:

determining an angle $\beta$ formed between the base member and a longitudinal axis of the head member;

presetting a desired moving direction value v for the load application point by means of a drive direction selector of a drive direction indicator provided on the head member;

readjusting the desired moving direction value by small increments toward a desired target for the load application point;

forming from the desired moving direction value a head axis component value $v_1$ which equals v cos $\alpha$ and a perpendicular axis component value $v_2$ which equals v sin $\alpha$, with $\alpha$ being an angle of misalignment between the longitudinal axis of the head member and the drive direction selector;

determining the pivotal speed $n_A$ of the base member about the axis of rotation A on the crane post in accordance with the equation $n_A = v_1/2L\pi \sin \beta$; and determining the pivotal speed $n_B$ of the head member about the common axis of rotation B in accordance with the equation $$n_B = -2n_A \sin^2 \frac{\beta}{2} \pm \frac{v_2}{2\pi L}.$$

2. A method according to claim 1, including forming the head axis component value $v_1$ and perpendicular axis component value $v_2$ using the drive direction indicator.

3. A method according to claim 2, wherein the drive direction indicator includes a pair of potentiometers mounted in a common plane and perpendicular to each other, means for supplying a supply voltage U to the potentiometers and a slide on each potentiometer, the head axis component and perpendicular axis component $v_1$ and $v_2$ being provided as a partial voltage of the supply voltage U taken from each potentiometer of the pair of potentiometers respectively.

4. A method according to claim 3, including providing the supply voltage U to correspond to the desired movement direction value v.

5. A method according to claim 4, including independently varying changes in the pivotal speeds in addition to their being calculated on the basis of the supply voltage U.

6. A method according to claim 5, including independently varying the change in pivotal speeds by increasing the supply voltage independently of the desired value v.

7. A method according to claim 6, including an additional potentiometer for receiving the supply voltage and controlling the additional potentiometer to vary the supply voltage.

8. A device for controlling horizontal motion of a load application point on an articulated crane having a crane post, a base member pivotally mounted on the crane post about a first axis A, and a head member pivotally mounted to an end of the base member about a second axis B between an angle $\beta$ of from 0° to 360° with respect to the base member and of a length L substantially the same as that of the base member, the head member carrying the load application point at an outer end thereof, comprising:

a direction indicator on the base member for indicating directions toward which the load application point can be moved;

a direction selector movably mounted on the direction indicator for movement toward a desired direction v for the load application point;

an angle sensor associated with the second axis B for detecting the angle $\beta$;

direction component calculation means associated with said direction indicator and direction selector for calculating a first component $v_1$ of the desired direction along a major axis of the head member, which first component equal v cos $\alpha$, and a second direction component $v_2$ perpendicular to the first component which is equal to v sin $\alpha$, where $\alpha$ is equal to a misalignment angle between the longitudinal axis of the head member and the desired direction v of the direction indicator;

first pivotal speed calculating means for calculating the pivotal speed $n_A$ of the base member about the first axis A which is equal to $v_1/2L\pi \sin \beta$; and second pivotal speed calculation means for calculating the pivotal speed $n_B$ of relative rotation between the head member and base member about the second axis B which is equal to $-2\ n_A \sin^2 \beta/2 \pm v_2/2\pi L$.

9. A device according to claim 8, wherein said angle sensor comprises a pair of mutually perpendicular potentiometers extending in a common plane and in said direction indicator, said potentiometers each having a slide connected to said direction indicator, and a voltage source connected to said potentiometers for supplying a supply voltage U thereto, voltages tapped from said pair of potentiometers representing partial voltages of said supply voltage corresponding respectively to the first and second direction components $v_1$, $v_2$.

10. A device according to claim 9, wherein said first pivotal speed calculation means comprises a first summing amplifier(17) connected to the one of said potentiometers for generating a partial voltage corresponding to said first direction component $v_1$ for multiplying the partial voltage of said first direction component by $\frac{1}{2}\pi L$, a division unit connected to an output of said first summing amplifier for dividing the output of said first summing amplifier by sin $\beta$, a first function generator connected between an output of said angle sensor and an input of said division unit for generating the value sin $\beta$, an output of said division unit forming said desired pivotal speed $n_A$.

11. A device according to claim 10, including a first integrator connected to said division unit for integrating the desired pivotal speed value $n_A$.

12. A device according to claim 11, including a second summing amplifier connected to the other of said potentiometers for generating a partial voltage corresponding to said second direction component $v_2$, for multiplying the partial voltage of said second direction component by $\frac{1}{2}\pi L$ to form value $n_{B2}$ at an output thereof, a second function generator connected to said angle sensor for generating a value sin $\beta/2$, a squaring unit connected to said second function generator for generating the value $\sin^2 \beta/2$, a multiplying amplifier connected to an output of said division unit and an output of said squaring unit for multiplying the outputs together and by $-2$ to generate a value $n_{B1}$, and an adder connected to the outputs of said second summing amplifier and said multiplication unit for generating the pivotal speed value $n_B$.

13. A device according to claim 12, including a second integrator connected to an output of said adder for integrating the pivotal speed value $n_B$.

14. A device according to claim 13, including a control amplifier connected to an output of said division unit and said adder for receiving the pivotal speed value $n_A$ and $n_B$, said control amplifier comprising said voltage supply for the supply voltage U, said control amplifier connected to said pair of potentiometers.

15. A device according to claim 14, including a voltage setting element connected between said control amplifier and said potentiometers for setting an overall value of the supply voltage U.

* * * * *